US005146705A

United States Patent [19]

Martin

[11] Patent Number: 5,146,705

[45] Date of Patent: Sep. 15, 1992

[54] TRIGGER AND SAFETY

[75] Inventor: Ronald J. Martin, Miami, Fla.

[73] Assignee: R/M Equipment, Inc., Miami, Fla.

[21] Appl. No.: 654,211

[22] Filed: Feb. 8, 1991

[51] Int. Cl.[5] ..... F41A 17/46

[52] U.S. Cl. ..... 42/70.06

[58] Field of Search ..... 42/70.06, 70.11, 70.07

[56] References Cited

U.S. PATENT DOCUMENTS

| | | | |
|---|---|---|---|
| 351,262 | 10/1886 | Goltstein | 42/70.06 |
| 2,978,826 | 4/1961 | Ivy | 42/70.06 |
| 3,269,046 | 8/1966 | Schaeffer | 42/70.06 |
| 4,604,498 | 8/1986 | Johnson | 42/70.11 |

FOREIGN PATENT DOCUMENTS

| | | | |
|---|---|---|---|
| 0138331 | 12/1952 | Sweden | 42/70.07 |

*Primary Examiner*—Michael J. Carone

*Attorney, Agent, or Firm*—Lawrence M. Nawrocki

[57] ABSTRACT

An auxiliary weapon, such as a grenade launcher, is mounted on a main weapon, such as a rifle. The trigger member of the auxiliary weapon includes a pivotal extension that may be moved to a locked position to retain the safety in its on position. The extension in its unlocked position is adjacent the trigger member of the main weapon to allow both weapons to be easily fired using the same hand.

12 Claims, 3 Drawing Sheets

TRIGGER AND SAFETY

TECHNICAL FIELD

The present invention relates to an improved trigger and safety combination for a weapon. More particularly, the present invention relates to such a combination for use with an auxiliary weapon device, such as a grenade launcher, carried on weapon, such as a rifle.

BACKGROUND OF THE INVENTION

Various weapons are known which mount an additional or auxiliary weapon. For example, a grenade or gas launcher can be mounted on a rifle. Both the main and auxiliary weapons are operated by rotatable trigger members. In addition, both usually also have safety mechanisms.

One difficulty with prior art devices of this type is that faced by the user in operating both trigger members. These trigger members are usually somewhat spaced apart, requiring the user to move his hand from one trigger member to the other to fire one weapon or the other. This can be confusing to do in the heat of battle. Obviously, any extra difficulty encountered in discharging the various weapons is disadvantageous.

In addition, the safety of the auxiliary weapon is prone to being accidentally released. This is especially true since the user is not always as familiar with the operation of the auxiliary weapon as with the main weapon. Thus, since the safety is released by a simple pivotal movement in many cases, this can be accidentally done by the user as he reaches for the trigger member for the auxiliary weapon.

SUMMARY OF THE INVENTION

One aspect of this invention is to provide a trigger and safety combination for use with an auxiliary weapon which prevents accidental release of the safety and which enables the trigger member for the auxiliary weapon to be easily actuated.

These and other aspects of the present invention are accomplished in a main weapon equipped with an auxiliary weapon. The main weapon is fired by a first trigger member and the auxiliary weapon is fired by a second trigger member. The improvement relates to an improved trigger and safety combination for the auxiliary weapon which comprises a safety mechanism on the auxiliary weapon for preventing the second trigger member from rotating. In addition, a lock member on the second trigger member may be selectively placed in abutting engagement with the safety mechanism for preventing the safety mechanism from being accidentally released.

The lock member preferably comprises an extension mounted on the second trigger member for selective movement between a locked position in which the extension abuts against the safety mechanism and an unlocked position in which the extension is released from the safety mechanism. The extension in the unlocked position thereof is relatively closely adjacent the first trigger member on the main weapon so that the first and second trigger members may be easily operated by he same hand of the user.

BRIEF DESCRIPTION OF THE DRAWINGS

The present invention will be described hereafter in the Detailed Description, when taken in conjunction with the following drawings, in which like reference numerals refer to like elements throughout.

DETAILED DESCRIPTION

Figure 1:
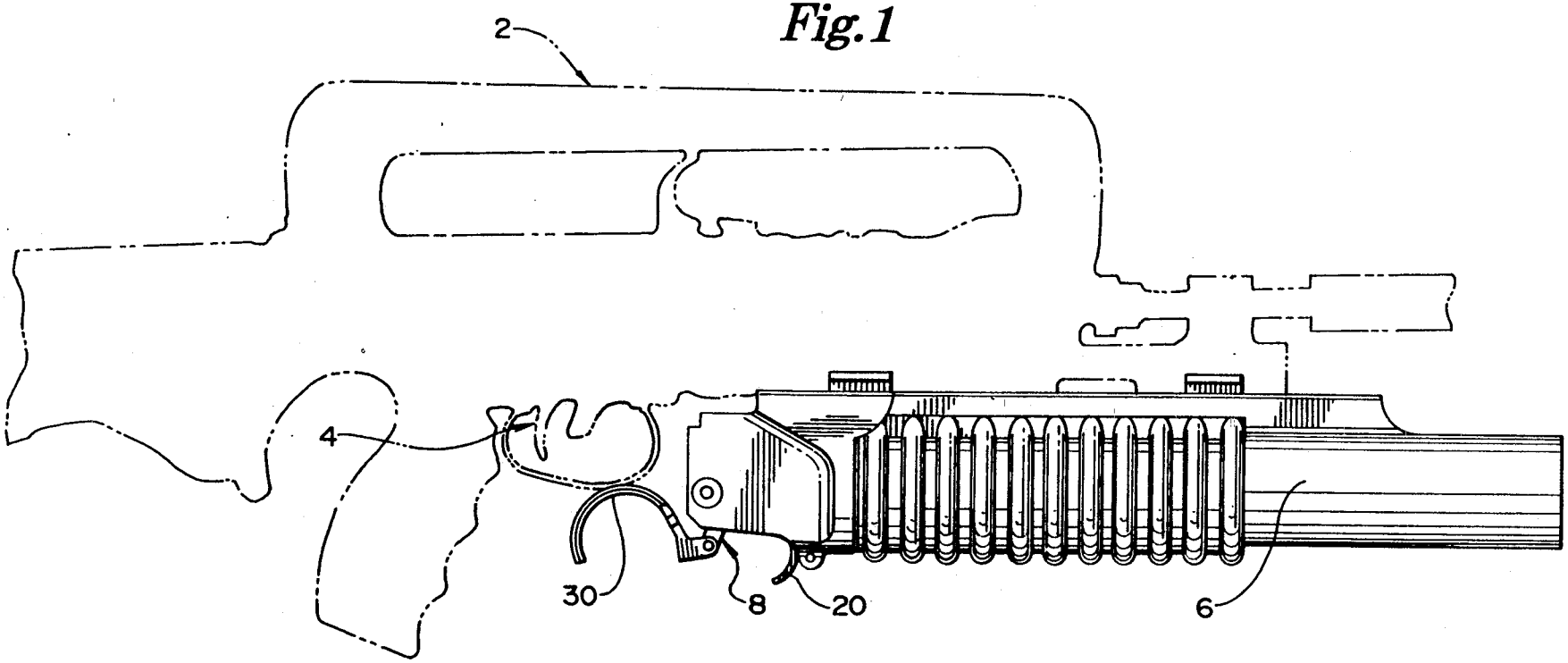
FIG. 1 is a side elevational view of a rifle equipped with an auxiliary weapon, such as a grenade launcher, particularly illustrating the trigger extenions of the auxiliary weapon in its unlocked position adjacent the trigger member of the rifle.

Referring now to FIG. 1, main weapon, such as a rifle, is illustrated generally as 2. Main weapon 2 may be of any suitable type and is not limited to a rifle or the type of rifle shown herein. Suffice it to say that weapon 2 is fired by pulling a first trigger member 4.

An auxiliary weapon 6 is mounted on main weapon 2. Auxiliary weapon 6 comprises a grenade launcher of any conventional design, such as the M203 PI launcher. Again, the present invention is not limited for use with a particular type of auxiliary weapon 6.

Figure 2:
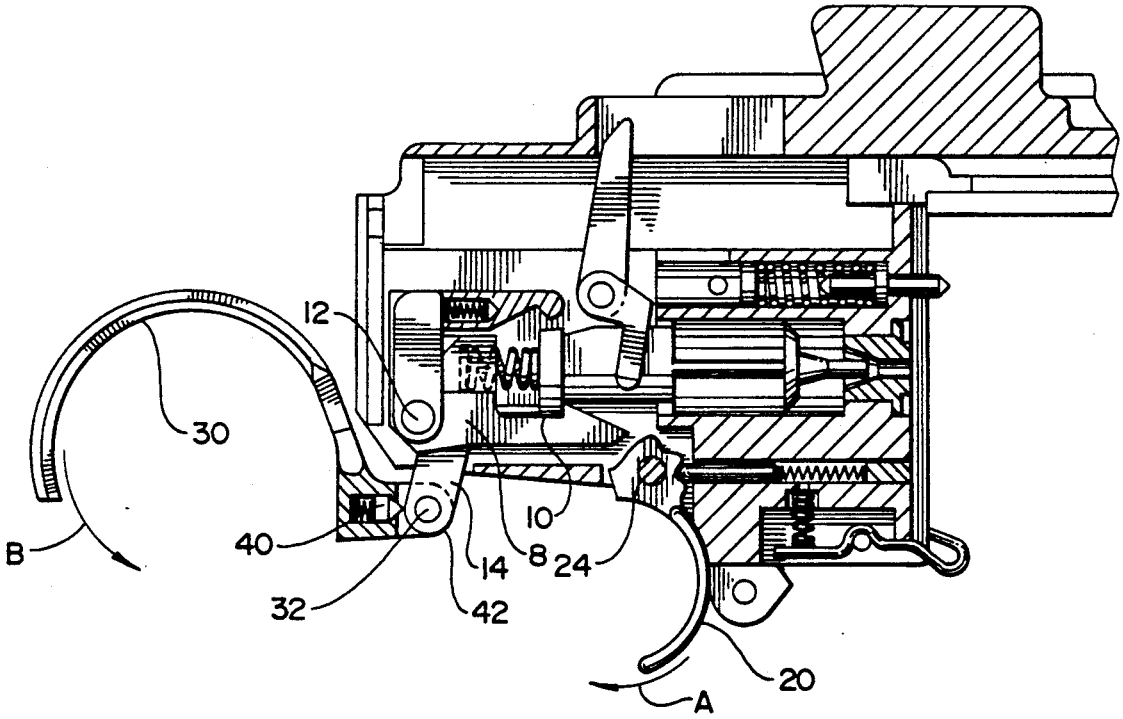
FIG. 2 is a cross-sectional view of a portion of the auxiliary weapon shown in FIG. 1, particularly illustrating the trigger extension in its unlocked position and the saftey in its off position.
Figure 4:
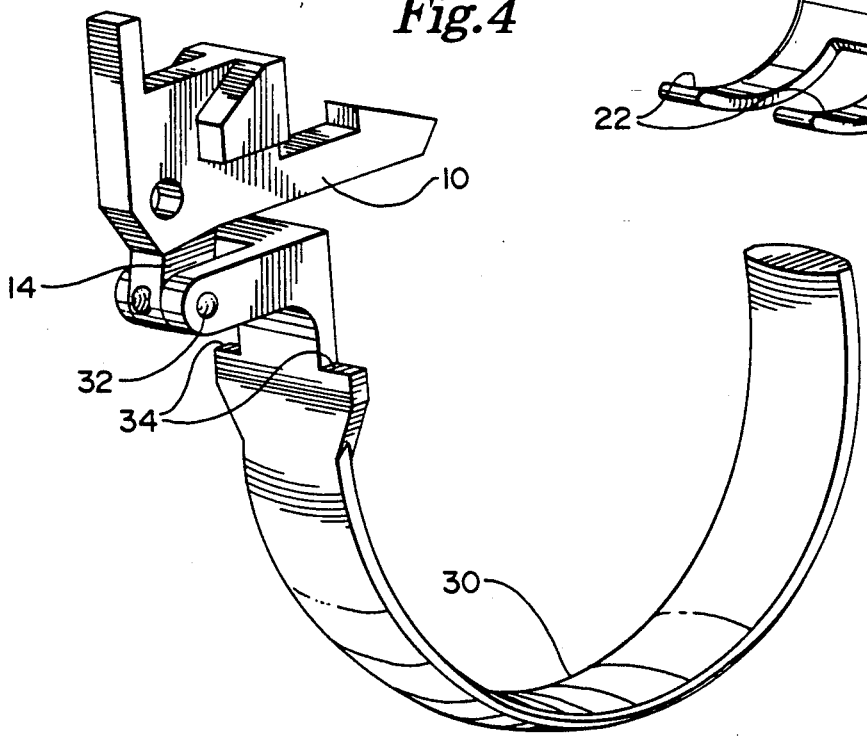
FIG. 4 is a perspective view of the trigger member of the auxiliary weapon shown in FIG. 1, also illustrating the pivotal extension therefor.

Auxiliary weapon 6 includes a second trigger member 8 for firing the weapon. Referring to FIGS. 2 and 4, trigger member 8 includes a forwardly extending actuating arm 10 pivotally mounted on a pivot pin 12. A trigger arm 14 extends down from actuating arm 10. Trigger arm 14 can be used to rotate actuating arm 10 about its pivot pin in a direction causing the weapon to fire. The other elements of trigger member 8 and its firing mechanism are conventional and need not be described here.

Figure 3:
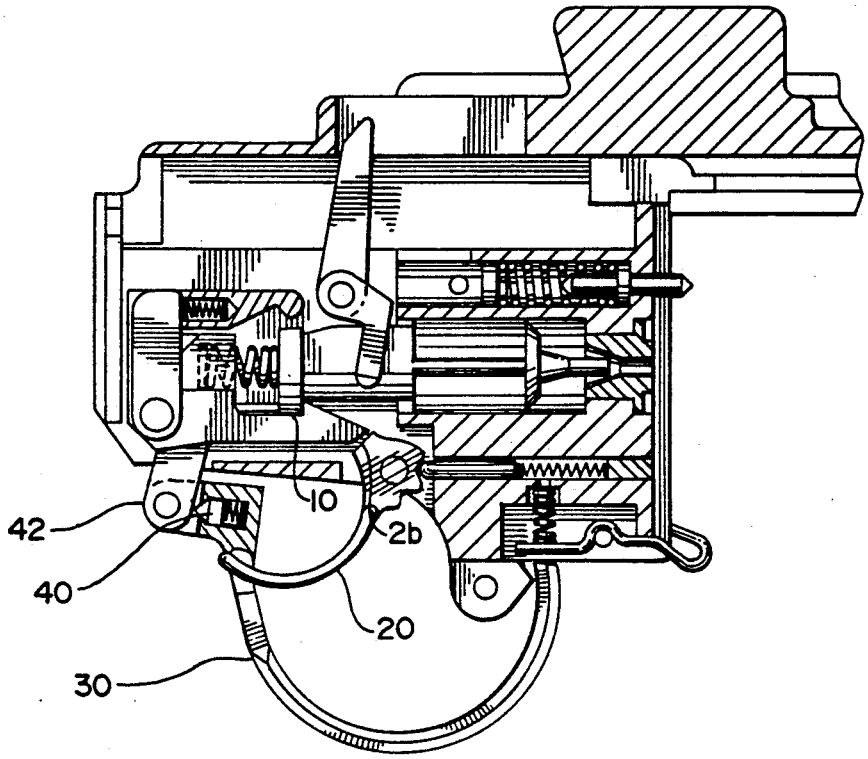
FIG. 3 is a cross-sectional view similar to FIG. 2, but showing the trigger extension in its locked position and the safety in its on position.
Figure 5:
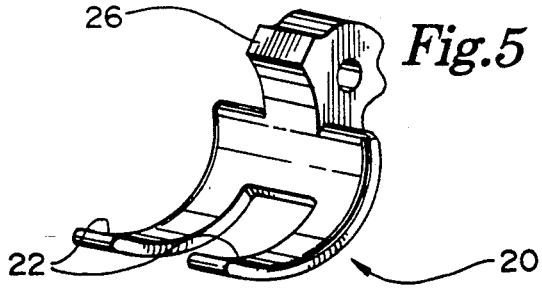
FIG. 5 is a perspective view of the safety of the auxiliary weapon shown in FIG. 1.

Auxiliary weapon 6 includes a pivotal safety 20 for preventing the rotation of trigger member 8. Safety 20 comprises spaced prongs 22 pivotally mounted for rotation on a horizontal pivot pin 24. See FIGS. 2 and 5. Safety 20 includes a locking surface 26 which abuts against the end of actuating arm 10 of trigger member 8 to prevent rotation of trigger member 8 when trigger member 8 is pulled. This is the "on" position of safety 20 illustrated in FIG. 3. Safety 20 also has an "off" position illustrated in FIG. 2. In this position, locking surface 26 on safety 20 has been rotated away from the end of actuating arm 10, allowing rotation of trigger member 8, and hence firing of auxiliary weapon 6.

Figure 6:
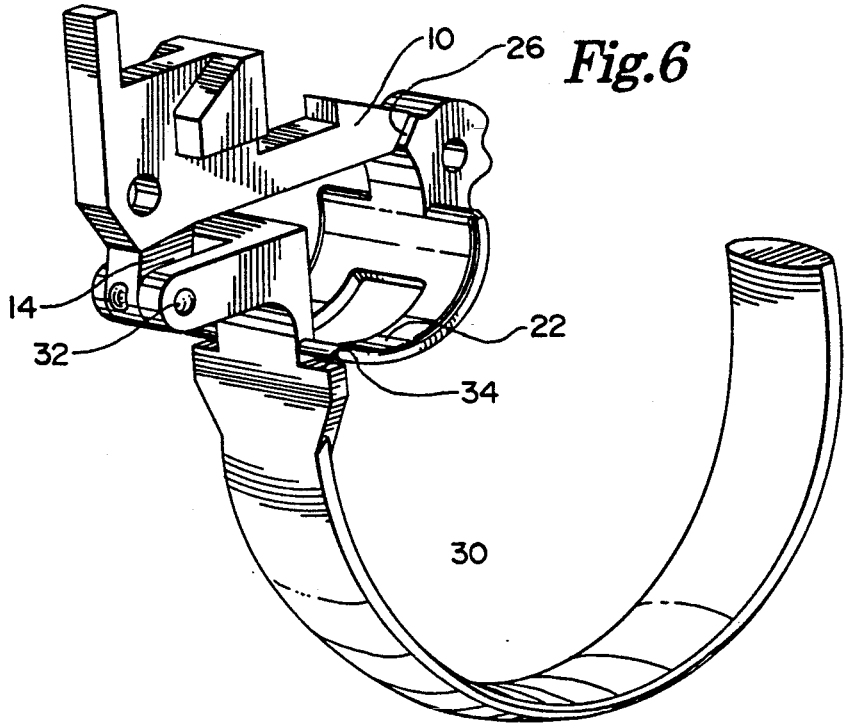
FIG. 6 is a perspective view of the trigger member and safety of the auxiliary weapon shown in FIG. 1, particularly illustrating the safety in its on position and the extension in its locked position with the components abutting one another.

The present invention relates particularly to a pivotal extension 30 carried on the lower end of trigger arm 14 in place of a normal fixed trigger element. Extension 30 comprises a curved elongated member, itself in the shape of a trigger, suited to interfit between prongs 22 of safety 20 as shown in FIG. 6. Extension 30 is pivotally carried on trigger arm 14 on a pivot pin 32 for rotation between two distinct positions, a "locked" position shown in FIG. 3 and an "unlocked" position shown in FIG. 2. Two laterally extending ears 34 project from each side of extension 30 for a purpose described hereafter.

FIG. 2 illustrates safety 20 in its off position and extension 30 in its unlocked position. Safety 20 may be manually rotated from its off to its on position, shown in FIG. 3, as depicted by the arrows A in FIG. 2. With safety 20 in its on position, extension 30 may then be rotated from its unlocked position to its locked position, also shown in FIG. 3, as depicted by the arrows B in FIG. 2. In this locked position, extension 30 has rotated downwardly to come within the prongs of safety 20 with ears 34 coming closely adjacent and underlying prongs 22 of safety 20. This is advantageous as safety 20 can no longer be accidentally released since prongs 22 would otherwise engage ears 34.

Thus, in order to fire auxiliary weapon 6, the user first has to rotate trigger extension 30 to its unlocked position shown in FIG. 2 to allow ears 34 on extension 30 to clear prongs 22 of safety 20. Safety 20 may then be manually rotated to its off position. Then, weapon 6 may be fired by pulling on trigger extension 30, which rotates trigger arm 14 and trigger member 8 about pivot pin 12. Thus accidental discharge of weapon 6 is prevented as the user has to consciously rotate extension 30 out of the way of safety 20 to allow safety 20 to be released.

Trigger extension 30 is provided with detent means for holding trigger extension 30 in its locked or unlocked positions. This detent means comprises a spring biased detent member 40 in the upper end of extension 30 and two spaced notches 42 on the lower end of trigger arm 14. Notches 42 are spaced apart from each other by approximately 180°, i.e. the amount of rotation of extension 30 between the locked and unlocked positions thereof. The head of detent member 40 is received in one of the notches 42 to hold trigger extension 30 in the locked and unlocked positions shown in FIGS. 3 and 2, respectively. While one particular form of detent means has been shown herein, any other suitable detent means, such as frictional detent means may be used.

Another feature of this invention is the placement of trigger extension 30 adjacent the first trigger member 4 when extension 30 is unlocked. See FIG. 1. This placement is desirable since either the first or second trigger members 4 or 8 may be easily fired by the user using the same hand. There is no need to search for trigger extension 30, or to reach for extension 30, due to the close proximity of trigger extension 30 to first trigger member 4.

Numerous characteristics and advantages of the invention have been set forth in the foregoing description. It will be understood, of course, that this disclosure is, in many respects, only illustrative. Changes can be made in details, particularly in matters of shape, size, and arrangement of parts without exceeding the scope of the invention. The invention's scope is defined in the language in which the appended claims are expressed.

What is claimed is:

1. In a main weapon equipped with an auxiliary weapon mounted thereon, wherein the main weapon is fired by a first trigger member and the auxiliary weapon is fired by a second trigger member and safety combination for the auxiliary weapon which comprises:

(a) a safety mechanism on the auxiliary weapon for preventing the second trigger member from rotating; and (b) a lock member on the second trigger member which may be selectively placed in abutting engagement with the safety mechanism for preventing the safety mechanism from being accidentally released.

2. In a main weapon as recited in claim 1, wherein the lock member comprises an extension mounted on the second trigger member for selective movement between a locked position in which the extension abuts against the safety mechanism and an unlocked position in which the extension is released from the safety mechanism.

3. In a main weapon as recited in claim 2, wherein the extension is pivotally mounted on the second trigger member.

4. In a main weapon as recited in claim 3, wherein the second trigger member is pivotally mounted on the auxiliary weapon for rotation about a pivot axis different from the pivot axis for the extension, whereby the extension is separately pivotally movable on the second trigger member.

5. In a main weapon as recited in claim 2, further including detent means for holding the extension in its locked and unlocked positions.

6. In a main weapon as recited in claim 5, wherein the detent means comprises a spring biased detent member cooperating with spaced detents.

7. In a main weapon as recited in claim 6, wherein the detents are located on the second trigger member and the detent member is located on the extension.

8. In a main weapon as recited in claim 2, wherein the extension in the unlocked position thereof is relatively closely adjacent the first trigger member on the main weapon so that the first and second trigger members may be easily operated by the same hand of the user.

9. In a main weapon as recited in claim 8, wherein the extension is a curved elongated member in the shape of a trigger.

10. In a main weapon as recited in claim 2, wherein the safety mechanism comprises a pivotal safety carried on the auxiliary weapon for movement between an on position in which the safety abuts the second trigger member and an off position in which the safety is spaced from the second trigger member, wherein one of the safety or the extension is formed as a prong-shaped member which is sized to interfit with the other when the safety is placed in its on position and the extension is placed in its locked position.

11. In a main weapon as recited in claim 10, wherein the prong-shaped member is the safety.

12. In a main weapon as recited in claim 11, wherein the extension includes outwardly extending ears located closely beneath the prongs of the safety when the safety is placed in its on position and the extension is in its locked position.

* * * * *